US006223812B1

(12) United States Patent
Gough

(10) Patent No.: US 6,223,812 B1
(45) Date of Patent: May 1, 2001

(54) HEAT EXCHANGER CORE CONNECTION

(75) Inventor: Robert James Gough, Stoke-on-Trent (GB)

(73) Assignee: Serck Heat Transfer Limited, Birmingham (GB)

( * ) Notice: Subject to any disclaimer, the term of this patent is extended or adjusted under 35 U.S.C. 154(b) by 0 days.

(21) Appl. No.: 09/456,001

(22) Filed: Dec. 7, 1999

(30) Foreign Application Priority Data

Dec. 7, 1998 (GB) ..... 9826740

(51) Int. Cl.[7] ..... F28F 9/02

(52) U.S. Cl. ..... 165/173; 165/175; 165/67; 165/906

(58) Field of Search ..... 165/153, 173, 165/149, 178, 67, 175, 906

(56) References Cited

U.S. PATENT DOCUMENTS

| | | | | |
|---|---|---|---|---|
| 3,710,858 | * | 1/1973 | Young | 165/173 X |
| 3,793,701 | * | 2/1974 | Chartet | 165/173 X |
| 4,917,180 | * | 4/1990 | Wolf et al. | 165/175 X |
| 5,178,213 | * | 1/1993 | Watson et al. | 165/173 |
| 5,297,624 | * | 3/1994 | Haussmann et al. | 165/173 |
| 5,363,911 | * | 11/1994 | Velluet et al. | 165/175 X |
| 5,487,422 | * | 1/1996 | Bertva et al. | 165/153 X |
| 5,570,737 | * | 11/1996 | Tokutake | 165/67 |
| 5,676,200 | * | 10/1997 | Laveran | 165/173 X |
| 5,881,456 | * | 3/1999 | Bergins et al. | 165/173 X |
| 6,065,533 | * | 5/2000 | Woodhull, Jr. | 165/149 |

FOREIGN PATENT DOCUMENTS

| | | | | |
|---|---|---|---|---|
| 3047411 | * | 7/1982 | (DE) | 165/173 |
| 0022235 | * | 1/1981 | (EP) | 165/173 |
| 0 133 401 A1 | | 2/1985 | (EP) . | |
| 2 108 648 | | 5/1983 | (GB) . | |
| 9014571 | * | 11/1990 | (WO) | 165/173 |

* cited by examiner

*Primary Examiner*—Christopher Atkinson
(74) *Attorney, Agent, or Firm*—Ratner & Prestia

(57) ABSTRACT

The invention relates to a heat exchanger core for use in a fluid cooling apparatus, of the type comprising two tanks (12, 13), each provided with a tube plate (17), and a number of parallel tubes (15) through which the fluid to be cooled flows and around which a cooling fluid is passed. The tubes (15) extend between the two tube plates (17). A connecting strip (20) in the form of a strengthening comb connects the tank wall (12) and the tube plate (17). The strip (20) is provided with a tube plate location slot (18) and a recess (19) adapted to house the end of the tank wall (12). The connecting strip (20) has a number of tooth-like portions or fingers (40) which extend between the tubes (15) and are bonded to the tube plate (17), but not to the tubes (15) themselves. The fingers (40) add strength to the tube plate overhang, allowing the operating pressure in the chamber inside the tank (12) to be increased without the need to use a thicker tube plate (17).

9 Claims, 3 Drawing Sheets

HEAT EXCHANGER CORE CONNECTION

FIELD OF THE INVENTION

This invention relates to a heat exchanger core for use in a fluid cooling apparatus. The fluid may be oil, compressed air, fuel, exhaust gases or other fluid. In particular the invention relates to a heat exchanger core of the type comprising a number of parallel tubes through which the fluid to be cooled flows and around which a cooling fluid is passed, wherein the tubes extend between tube plates.

DESCRIPTION OF THE PRIOR ART

FIG. 1 shows a known cooling apparatus. The apparatus has an inlet 1, a first tank 2, a second tank 3 and an outlet 4. Oil is cooled by passing it through the inlet 1 into the first tank 2, and then through a number of tubes 5 to the second tank 3, from where it exits through the outlet 4. The tubes 5 are spaced apart so that coolant fluid (gas or liquid) can pass between the tubes 5. The tubes 5 are connected to each tank 2, 3 by means of a tube plate 7. The inside tank wall has a tube plate location slot 8 at each side, and the tube plate 7 is located in the two tube plate location slots and is fastened in place by some form of bonding technique.

Other methods of achieving the tank to tube plate connection in this form of heat exchanger are known. The simplest method is to extend the tank and tube plate so that they touch and then to use some form of bonding technique to achieve a simple butt joint. Alternatively the tube plate can be formed as a channel section, with the channel webs extending parallel to the tank walls locally, and the webs being joined to the tank wall.

The problem with all these methods is that as the pressure inside the enclosure or tank is increased, the overhanging portion of the tube plate bends towards the tank. This causes high local stresses either at the tank to plate joint or at the periphery of the outermost tube immediately adjacent to the tube plate. The magnitude of these local stresses limits the allowable operating pressure of the heat exchanger.

The conventional solution to the problem of increasing the pressure retention capability is to increase the tube plate thickness t. However the central portion 7*a* of the tube plate 7 does not need to be as thick as the overhanging portion 7*b*, so this solution results in adding unnecessary material to the structure. It also adds cost to the manufacture of the structure and hinders the piercing operation required to form the tube holes 6 in the tube plate 7. Another solution is to form a tube plate of varying thickness, but this would be costly since separate tooling would be required to form tube plates of different widths.

SUMMARY OF THE INVENTION

According to a first aspect of the present invention there is provided a fluid cooling apparatus for cooling a fluid comprising:

a tank having a tank wall, a tube plate having a plurality of apertures therein, and a plurality of internal tubes, each extending from a corresponding aperture in said tube plate and defining a fluid passage, said tank wall and said tube plate defining a chamber adapted to hold said fluid to be cooled, and said fluid passages of said internal tubes communicating with said chamber, wherein the tank wall is connected to the tube plate by means of a connecting strip member having a plurality of substantially parallel projecting tooth or finger-like portions.

Preferably the projecting tooth portions extend at least partially between said internal tubes. Preferably the projecting portions are bonded to the tube plate between said internal tubes. Preferably there is a clearance gap between each projecting portion and the adjacent internal tubes.

Preferably the connecting strip member is provided with a tube plate location slot in which is housed an edge of the tube plate.

Preferably the connecting strip member is provided with a tank wall location recess adapted to locate against an edge of said tank wall. Preferably the connecting strip member has a thickness in the region of the location recess greater than the thickness of the tank wall.

Preferably the internal tubes and apertures are substantially rectangular in cross-section. Each internal tube may be provided with ribs which extend longitudinally. Said ribs may sub-divide said internal tubes into a plurality of longitudinally extending passages. Alternatively the internal tubes may be circular or oval in cross-section.

Preferably the apparatus is made of metal, most preferably aluminium or aluminium alloy.

DESCRIPTION OF THE PREFERRED EMBODIMENT

Figure 1:
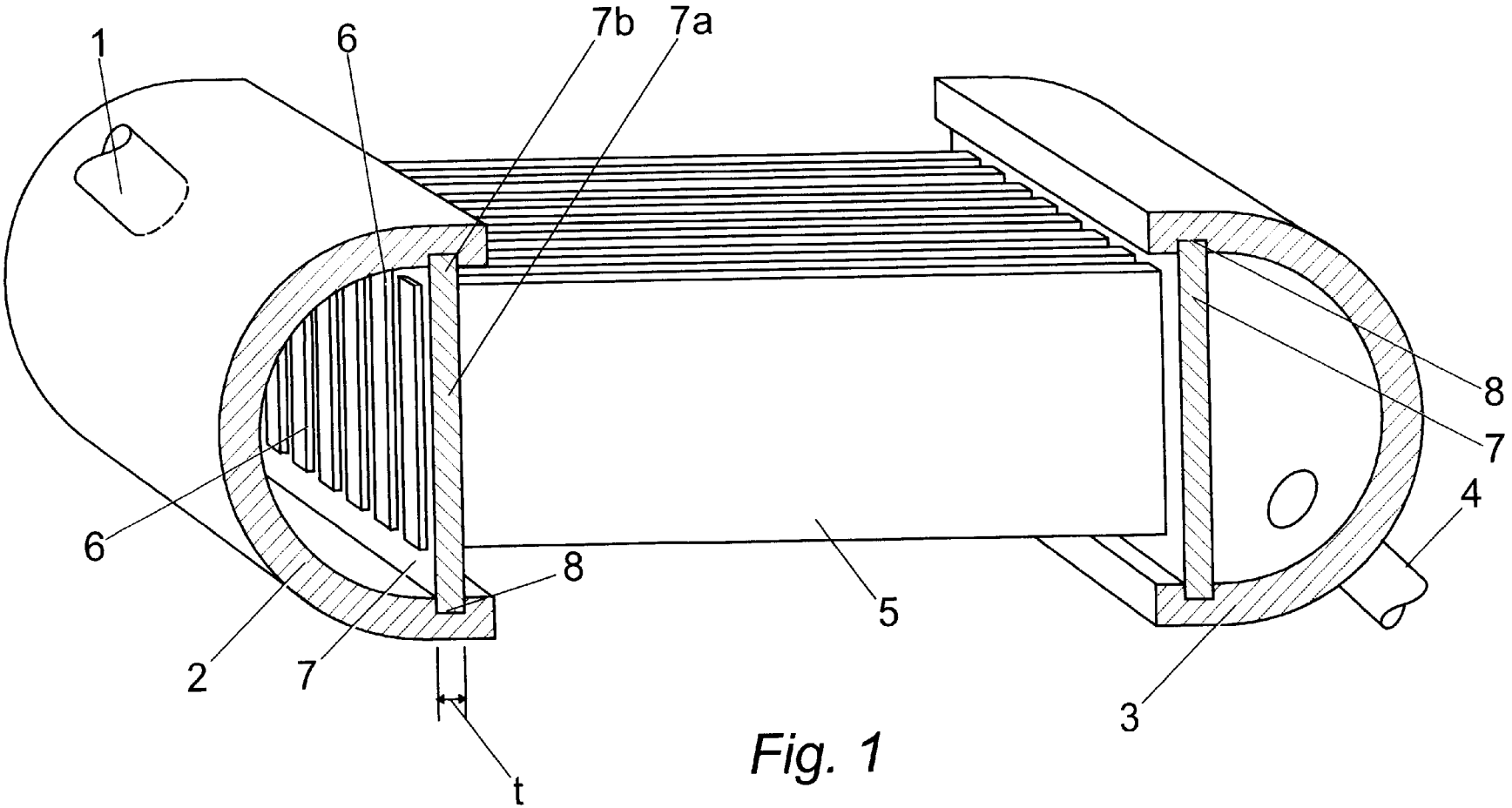
Fig. 1 Prior Art
FIG. 1 is a perspective sectional view through a prior art cooling apparatus.
Figure 2:
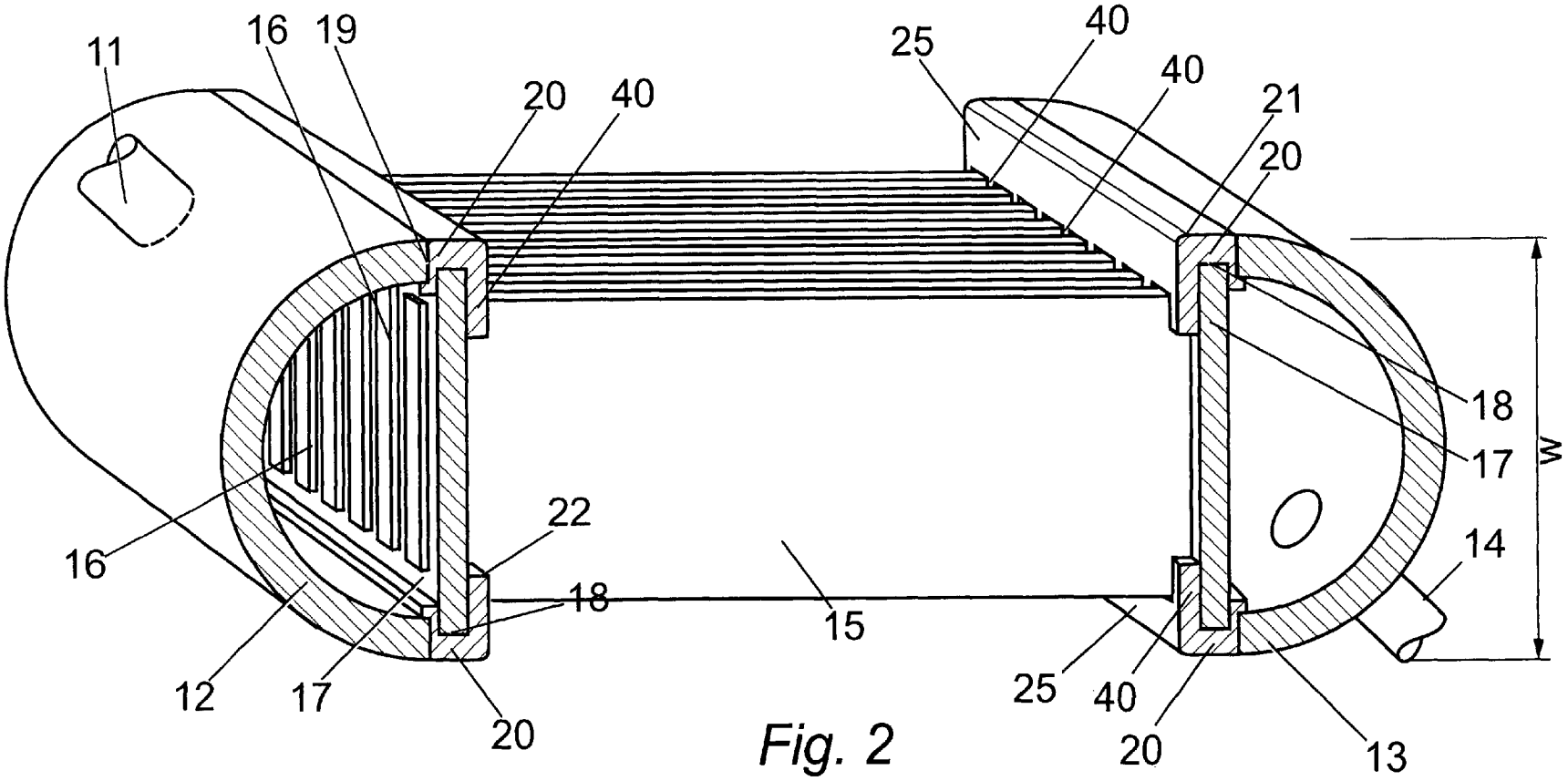
FIG. 2 is a perspective sectional view through a cooling apparatus according to the invention.
Figure 3:
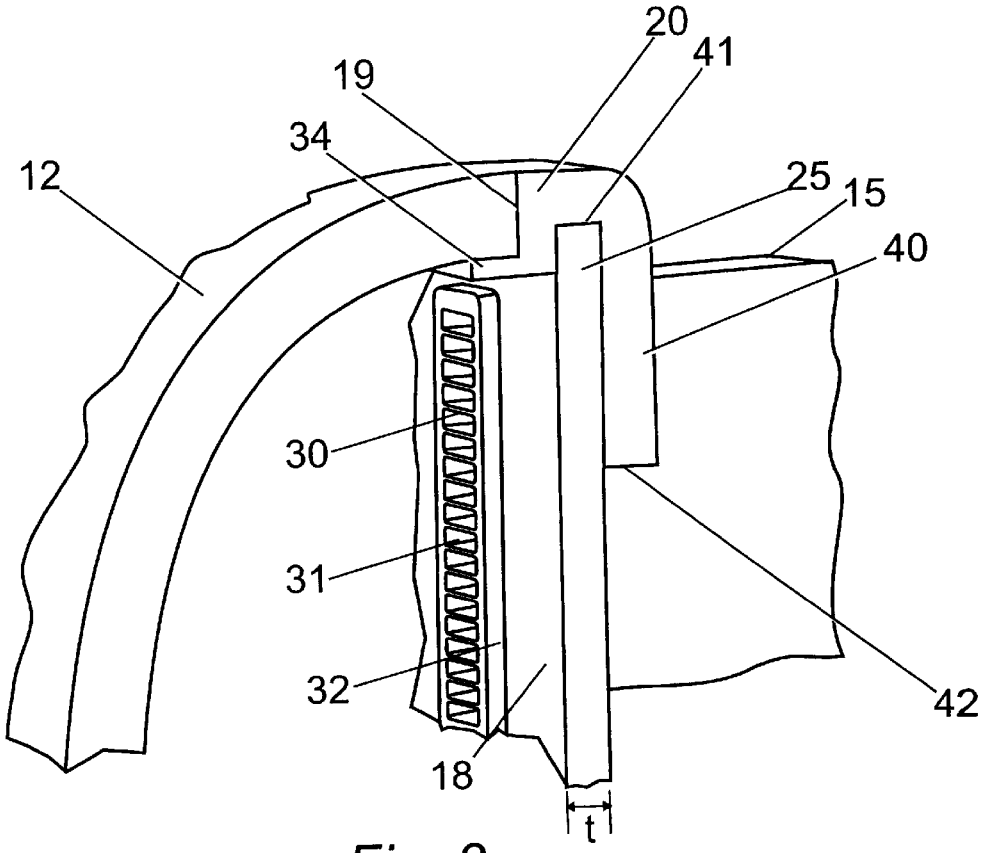
FIG. 3 is a partial enlarged view of the connection between the tube plate and the tank plate of the apparatus of FIG. 2.
Figure 4:
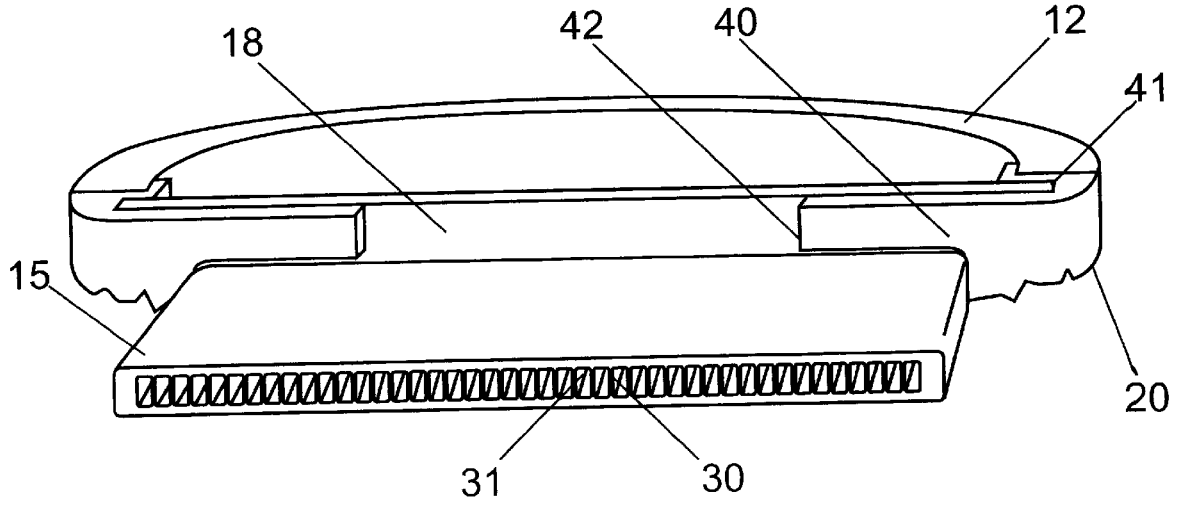
FIG. 4 is a partial enlarged view of the connection between the tube plate and the tank plate of the apparatus of FIG. 2 viewed in the direction of the axis of the internal tube.

Referring to FIGS. 2 to 4 there is shown a cooling apparatus according to a particular embodiment of the invention. The apparatus is an oil cooler and has a header tank 12 with an inlet 11 and a second tank 13 with an outlet 14. Oil is cooled by passing it through the heat exchanger core which comprises a number of tubes 15 which extend from the first tank 12 to the second tank 13. The tubes 15 of the core are spaced apart so that coolant fluid (gas or liquid) can pass between the tubes 15. Cooling fins (not shown) may be provided between the tubes, in a manner known to those skilled in the art. The tubes 15 are connected to each tank 12, 13 by means of a tube plate 17 provided with apertures 16 and a connecting strip 20. The connecting strip is an extruded metallic member which may have a rounded corner 21 or an angled corner 22. The connecting strip is provided with a tube plate location slot 18. The upper edge of the tube plate 17 is located in the tube plate location slot 18 of the upper connecting strip 20, while the lower edge of the tube plate 17 is located in the tube plate location slot 18 of the lower connecting strip 20. Typically the tube plate is fixed in the slot 18 by adhesive, brazing, welding or other form of bonding technique.

The tubes 15 typically have a wall thickness of between 0.4 mm and 1.0 mm. In the example shown they have a height of 60 mm and a width of 4 mm, but any dimensions are possible. They may be extruded, and may be provided with ribs 30 which extend across the width of the tube 15 to sub-divide the tubes into a number of separate longitudinal passages 31, as shown in FIGS. 3 and 4. The tubes 15 may be manufactured in any manner, from any suitable material and in any shape (rectangular, oval, circular etc).

The tube plate 18 joins the tubes 15 together to form a heat exchanger core. Each tube may end flush with the tube plate or may extend slightly past the tube plate to form a small projection 32 (as shown in FIG. 3). The tube plate typically is metallic and has a thickness of between 3 and 6 mm.

The tank wall 12 forms an enclosure or chamber with the tube plate 17. This enclosure may be pressurised.

The strengthening comb or connecting strip 20 is typically metallic, of an aluminium or alloy extrusion. It performs two functions.

Firstly it provides a flexible method of facilitating the joint between the tank wall 12 and tube plate 17, so that the joint is independent of tube plate size. To this end it is provided with a tube plate location slot 18 and a recess 19 adapted to house the end of the tank wall 12. An extending flange portion 34 provides additional local thickness and improved stress distribution. The connections to the connecting strip 20 may be by welding, brazing, adhesive or other bonding technique.

Secondly it provides additional strength at the critical area of the tube plate overhang 25, which is that area of the tube plate 17 which extends in a cantilever fashion beyond the tubes 15 and is subject to pressure on one side but has no restraining support on the other side.

The connecting strip 20 is provided with a number of projecting tooth portions or fingers 40, which each extend from the outer edge 41 of the tube plate 17 to a point 42 beyond the outermost periphery of any of the tubes 15. The fingers 40 are bonded to the tube plate, but are not necessarily bonded to the tubes 15 themselves, and add strength to the tube plate overhang, allowing the operating pressure in the chamber inside the tank 12 to be increased by up to a factor of two. However, weight is kept to a minimum, because the fingers 40 do not add unnecessary material to the tube plate 17. The same strengthening comb can be used on tube plates of widely varying width W. The tube plate location slot 18 eases manufacture and allows the tank 12 to be positioned closer to the tubes, thereby minimising the moment arm applied to the overhang 25. The tank location face 19 and flange 34 provide additional surface area for joining the tank and connecting strip, whether by welding, brazing or adhesives.

The connecting strip itself is manufactured by extrusion then punching to form the fingers, or by stamping, coating or injection moulding. The material used may be a metal, such as an aluminium alloy, or a plastic material.

In conclusion the use of a strengthening comb permits the pressure retention capability of this type of structure to be significantly increased, without adding unnecessary material or sacrificing flexibility with regard to varying tube plate widths.

The invention is not limited to the materials mentioned above, nor to the shapes of tank or tube shown in the drawings.

These and other modifications and improvements can be incorporated without departing from the scope of the invention.

What is claimed is:

1. A fluid cooling apparatus for cooling a fluid comprising:

a tank having a tank wall, a tube plate having a plurality of apertures therein, and a plurality of internal tubes, each extending from a corresponding aperture in said tube plate and defining a fluid passage, said tank wall and said tube plate defining a chamber adapted to hold said fluid to be cooled, and said fluid passages of said internal tubes communicating with said chamber, wherein the tank wall is connected to the tube plate by means of a rigid connecting strip member having a plurality of substantially parallel projecting tooth portions arranged to form a comb, whereby each tooth portion extends at least partially between said internal tubes and is bonded to the tube plate between said internal tubes in order to locally increase the material thickness of the tube plate.

2. The fluid cooling apparatus of claim 1, wherein there is a clearance gap between each projecting tooth portion and the adjacent internal tubes.

3. The fluid cooling apparatus of claim 1, wherein the connecting strip member is provided with a tube plate location slot in which is housed an edge of the tube plate.

4. The fluid cooling apparatus of claim 3, wherein the connecting strip member is provided with a tank wall location recess adapted to locate against an edge of said tank wall.

5. The fluid cooling apparatus of claim 1, wherein the internal tubes and apertures are substantially rectangular in cross-section.

6. The fluid cooling apparatus of claim 1, wherein the internal tubes and apertures are substantially circular or oval in cross-section.

7. The fluid cooling apparatus according to claim 1, wherein each internal tube is provided with ribs which extend longitudinally along the inside surface of the tube.

8. The fluid cooling apparatus of claim 7, wherein the ribs in each internal tube are arranged such as to sub-divide the internal tube into a plurality of longitudinally extending passages.

9. The fluid cooling apparatus of claim 1, wherein the apparatus is made of metal.

* * * * *